US005336020A

United States Patent [19]

Askestad

[11] Patent Number: 5,336,020

[45] Date of Patent: Aug. 9, 1994

[54] SUPPORT AND CONNECTION DEVICE FOR FLEXIBLE RISER

[75] Inventor: Sigmund Askestad, Saetre, Norway

[73] Assignee: Norsk Hydro a.s., Oslo, Norway

[21] Appl. No.: 70,342

[22] PCT Filed: Sep. 30, 1992

[86] PCT No.: PCT/NO92/00164

§ 371 Date: May 28, 1993

§ 102(e) Date: May 28, 1993

[87] PCT Pub. No.: WO93/07048

PCT Pub. Date: Apr. 15, 1993

[30] Foreign Application Priority Data

Sep. 30, 1991 [NO] Norway ..... 913824

[51] Int. Cl.[5] ..... E02D 5/74

[52] U.S. Cl. ..... 405/224; 405/195.1; 166/355

[58] Field of Search ..... 405/195.1, 223.1, 224; 166/351, 359, 367, 355

[56] References Cited

U.S. PATENT DOCUMENTS 3,339,512 9/1967 Siegel ..... 166/351 X
3,369,599 2/1968 Evans ..... 166/350
3,380,520 4/1968 Pease ..... 166/351 X
3,407,768 10/1968 Graham .
3,612,176 10/1971 Bauer ..... 166/359
3,735,435 5/1973 Mikullcic et al. .
3,921,557 11/1975 Kapteijn et al. .
4,142,584 3/1979 Brewer et al. .
4,516,881 5/1985 Beynet et al. .
4,606,727 8/1986 Koenig et al. .
4,646,841 3/1987 Schawann et al. ..... 166/359 X
4,650,431 3/1987 Kentosh .
4,698,038 10/1987 Key et al. .
4,701,143 10/1987 Key et al. ..... 405/202 X

FOREIGN PATENT DOCUMENTS 0207915 1/1987 European Pat. Off. .
0399719 11/1990 European Pat. Off. .
165285 10/1990 Norway .

*Primary Examiner*—Dennis L. Taylor
*Attorney, Agent, or Firm*—Wenderoth, Lind & Ponack

[57] ABSTRACT

A flexible riser extends from a wellhead on a seabed to a pipe system on a turret on a floating structure, such as a drilling or production vessel for recovery of oil and gas, through a guide pipe in the turret. The riser is connected with a rigid pipe which extends from a lower edge of the turret through the guide pipe in the turret and to the pipe system on the deck of the structure. The rigid pipe is fitted at an angle to the vertical, which angle essentially corresponds to the natural angle of the riser.

18 Claims, 2 Drawing Sheets

SUPPORT AND CONNECTION DEVICE FOR FLEXIBLE RISER

BACKGROUND OF THE INVENTION

The present invention concerns a device associated with a flexible riser for a floating structure such as a drilling or production ship for recovery of oil and gas, where the riser extends from a wellhead on the seabed to a pipe system on the floating structure.

Since oil and gas are recovered from increasingly greater depths, there has been a growing need to use floating structures for such recovery. Since a floating structure moves in relation to the seabed, it is necessary to use flexible risers which, as mentioned above, extend from a wellhead on the seabed to a pipe system on the floating structure. The floating structure may be either dynamically positioned, or moored to the seabed by means of mooring lines. To enable the floating structure to turn in response to wind or weather, the riser and any relevant mooring lines are led via a so-called turret which is rotatably mounted on the structure. The flexible risers are normally led through a continuous guide pipe in the turret and are connected directly to the pipe system on the deck of the turret by means of couplings. The guide pipes are installed vertically in the turret, and to avoid the risers being subject to kinking and rubbing against the underside of the turret, it is commonly known either to supply the risers with bend restrictors or to supply the guide pipes with funnel-shaped ends, thereby to attempt to ensure that the flexible risers have a limited bending radius.

Using continuous guide piping makes it difficult or (depending on the diameter) impossible to inspect the part of the risers which is inside the guide pipes. One major disadvantage of using bend restrictors is that the flexible pipes are subject to extra strain because of the pressure forces exerted by the restrictors. These forces create pressure forces between the various layers within the flexible pipes, which in turn leads to internal wear and tear in the pipe walls. Also, wobble may occur between the attached restrictor and the pipe wall because of the internal wear of the pipe wall, wear between the pipe wall and the restrictor, and shrinkage of the plastic materials. This wobble may lead to the restrictor being displaced so that the riser is subject to harmful bending, and further external wear on the riser in the area where it enters the guide pipe. Detection of this wear and wobble cannot be made by external inspection. A disadvantage of using a funnel-shaped termination or end on the guide pipe is that the riser is subject to concentrated lateral loads. A further disadvantage is that wear occurs on the surface between the riser and the funnel, and internal wear occurs in the riser wall as a result of these concentrated lateral loads. To reduce wear on the riser, spacers are sometimes used between the riser and the guide pipe. However, these spacers make it quite impossible to inspect the part of the flexible riser which is inside the guide pipe.

Both the solutions described above, using a bend restrictor or a funnel-shaped part, thus entail a number of disadvantages which could lead to rupture of the riser and thus harmful release of oil and gas.

SUMMARY OF THE INVENTION

The object of the present invention is to provide a solution for flexible risers which eliminates the disadvantages described above, i.e. where uncontrolled bending and stretching of the risers is eliminated. The solution of the invention moreover is fireproof, and eliminates internal and external wear and tear. In addition, the solution of the invention will enable full inspection to be made in the area where the riser passes through the turret.

BRIEF DESCRIPTION OF THE DRAWINGS

The invention will now be described in more detail with reference to the accompanying drawings in which.

DETAILED DESCRIPTION OF THE INVENTION

Figure 1:
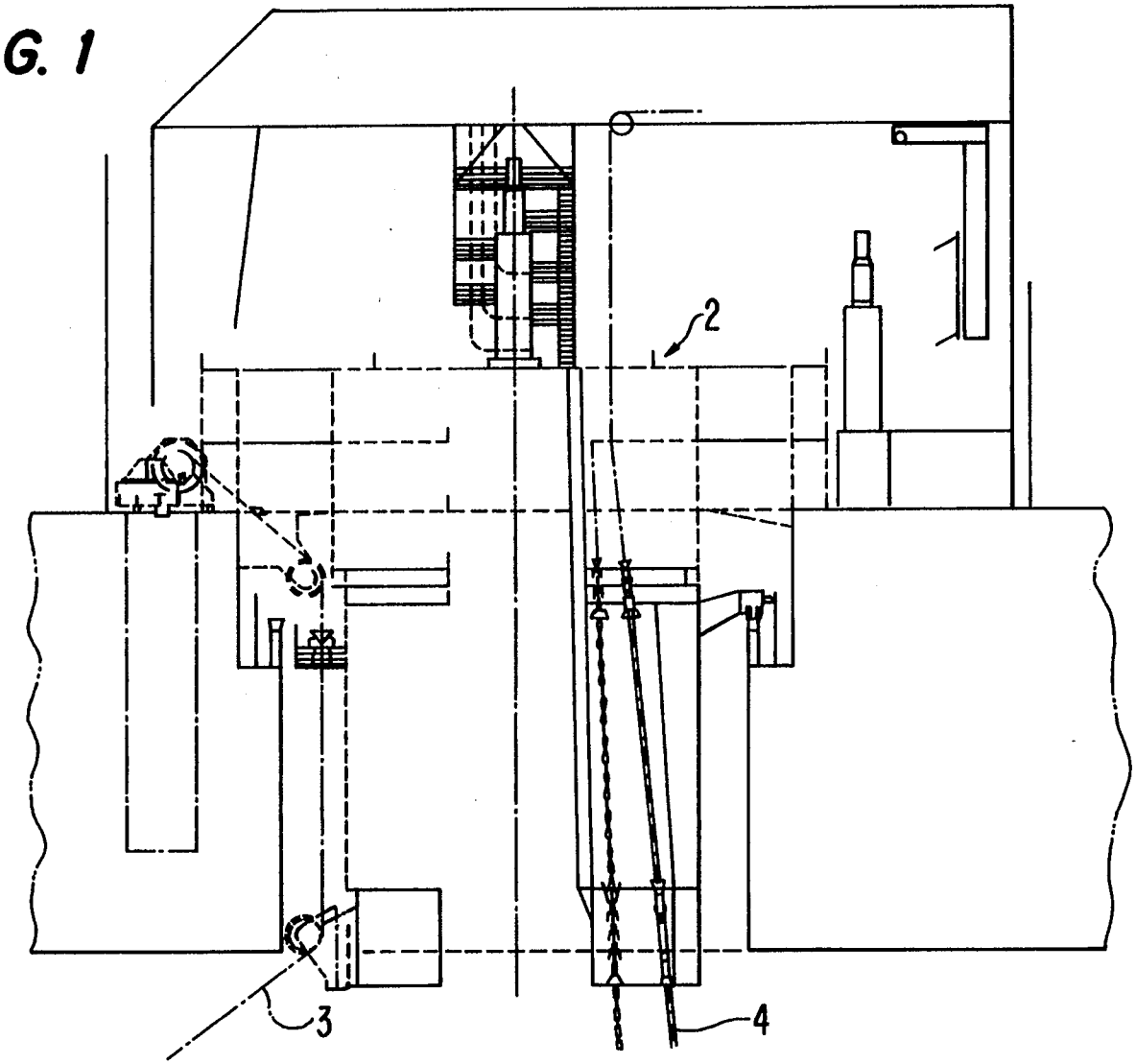
FIG. 1 is a schematic view showing part of a ship with a turret and a number of risers.
Figure 2:
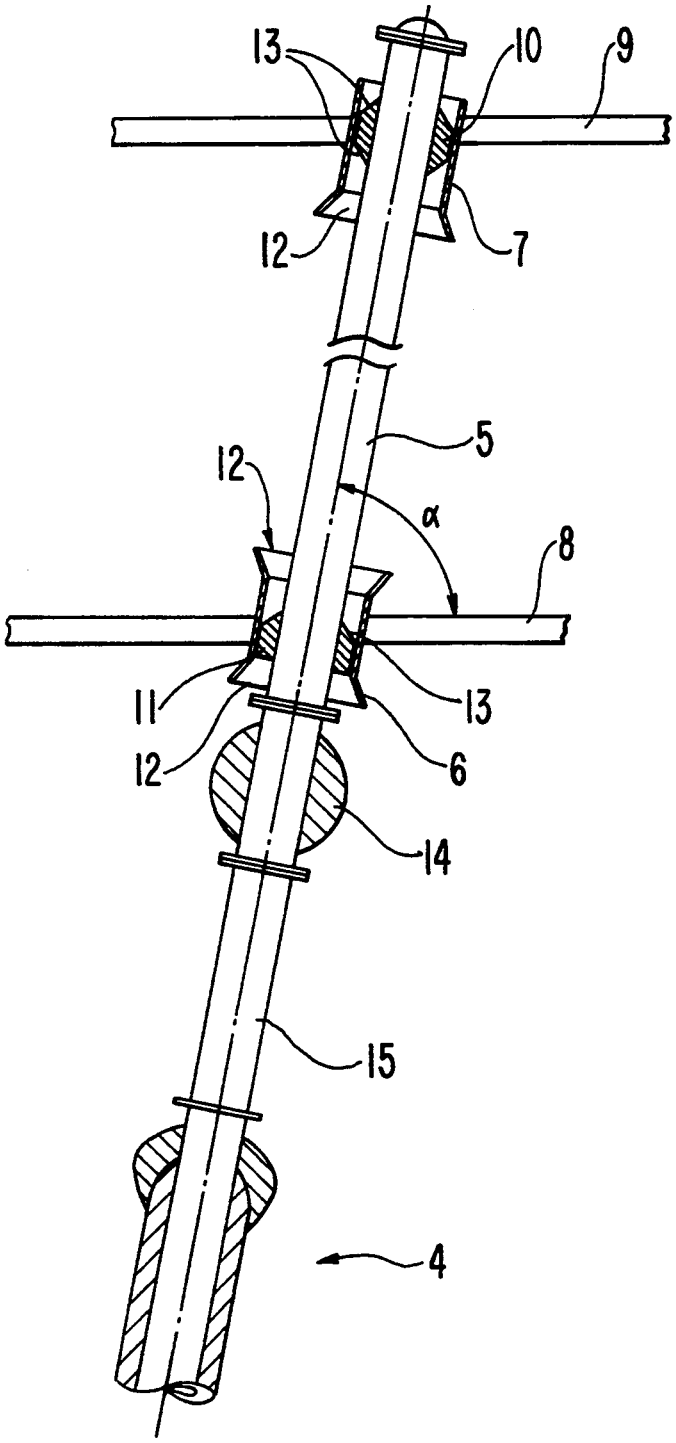
FIG. 2 is a partial sectional view, on an enlarged scale, of an upper part of a riser shown in FIG. 1.

FIG. 1 shows, as mentioned above, part of a floating structure in the form of a drilling or production ship 1 with a turret 2. The ship is moored by means of mooring lines, one of which is shown at 3, passing through turret 2. Oil and gas flows from a wellhead on the seabed (not shown) through risers 4 to a pipe system on the ship. The upper part of one of the risers, i.e. that part which passes through the turret 2, is shown on a larger scale in FIG. 2.

Instead of using a flexible riser which extends up through a continuous guide pipe in the turret and is coupled directly to the pipe system on the deck of the turret, as is commonly known, the present invention is based on a solution whereby the flexible riser is coupled to a rigid pipe 5 of metal or other material which extends from the lower edge of the turret through a lower guide sleeve 6 in a base structure 8 of the turret and through an upper guide sleeve 7 in a deck structure 9 of the turret, and then to the pipe system on deck. The rigid pipe 5 is provided with spacers 11, 10 to prevent wear and tear between pipe 5 and the guide sleeves 6 and 7, respectively. To facilitate introduction and extraction (installation and dismantling) of the pipe 5, the sleeves 6, 7 are provided with funnel-shaped ends 12 and the spacers 10, 11 are equipped with conical ends 13.

By using a divided guide pipe in the form of upper and lower guide sleeves, it is possible to carry out a full external inspection of the riser, i.e. the pipe 5, in the turret. Use of rigid pipe 5 also makes it possible to carry out a complete internal inspection thereof, by means of ultrasound, for example. This is not possible with flexible risers.

In accordance with one important feature of the invention, the rigid pipe is fitted at an angle $\alpha$ which is essentially the same as the natural angle of the riser from the wellhead to the ship. The advantage of this angled installation of the pipe is that it is subject to lower average strain due to bending at the lower edge of the guide sleeve. An advantage of using a rigid pipe 5 is that load-bearing forces from the flexible riser are absorbed by the rigid spacers 10, 11 which can be welded to the rigid pipe 5, such that the rigid pipe itself is not subjected to wear and tear (wear occurs only between the spacers and the guide sleeves).

A flexible joint 14 preferably may be installed between the flexible riser 4 and the rigid pipe 5. This will further reduce bending effects in the flexible riser. Furthermore, a short, rigid pipe 15 preferably may be inserted between the flexible joint 14 and the flexible pipe 4. The advantage of this arrangement is that flexion occurs in a flexible section with rigid pipe on both sides and not in the flexible riser 4. The flexible section may be of a standard type of "flex joint" which is made of reinforced elastomer with an internal pipelining. A metal pipe with a high modulus of elasticity, for example titanium, could also be used.

Although the above shows an example of how a divided guide pipe in the form of two guide sleeves can be used to advantage, it should be noted that the invention as defined is not limited to such arrangement, but can be executed with a continuous guide pipe.

With the present invention, there is provided a riser which is not subject to harmful wear and tear or uncontrolled bending or stretching which would lead to breakage and subsequent leakage of oil and gas. Further, the invention is substantially more fireproof, since a metal pipe instead of a flexible pipe of plastic material is used for the part of the riser which is led through the vessel. Still further, the solution according to the invention requires considerably less space.

I claim:

1. In a floating structure such as a drilling or production vessel for the production of oil or gas and including a turret having a pipe system, and a flexible riser extending from a seabed wellhead through said turret to said pipe system, the improvement comprising:

a guide pipe mounted in said turret;

a rigid pipe connected to said flexible riser and forming an upper portion thereof extending through said turret from a lower end thereof to said pipe system; and said rigid pipe extending through said guide pipe and being guided thereby to extend at an angle to the vertical, said angle corresponding substantially to the natural angel of said flexible riser.

2. The improvement claimed in claim 1, further comprising a flexible joint mounted between said rigid pipe and said flexible riser.

3. The improvement claimed in claim 2, further comprising a short rigid pipe mounted between said flexible joint and said flexible riser.

4. The improvement claimed in claim 1, further comprising spacers between said rigid pipe and said guide pipe.

5. The improvement claimed in claim 1, wherein said guide pipe is divided and includes separate upper and lower guide sleeves, said upper guide sleeve being mounted in a deck structure of said turret, and said lower guide sleeve being mounted in a base structure of said turret.

6. The improvement claimed in claim 5, wherein said guide sleeves have funnel-shaped ends.

7. The improvement claimed in claim 5, further comprising spacers between said rigid pipe and said guide sleeves.

8. The improvement claimed in claim 7, wherein said spacers are integral with said rigid pipe and abut said guide sleeves.

9. The improvement claimed in claim 7, wherein said spacers have conical ends.

10. A device for connecting and supporting a flexible riser extending from a seabed wellhead through a turret on a floating structure, such as a drilling or production vessel for the production of oil or gas, to a pipe system on the turret, said device comprising:

a guide pipe to be mounted in the turret;

a rigid pipe to be connected to the flexible riser to form an upper portion thereof to extend through the turret from a lower end thereof to the pipe system; and said rigid pipe extending through said guide pipe and being guided thereby to extend at an angle to the vertical, said angle corresponding substantially to the natural angle of the flexible riser in use.

11. A device as claimed in claim 10, further comprising a flexible joint connected to said rigid pipe and to be connected to the flexible riser.

12. A device as claimed in claim 11, further comprising a short rigid pipe connected to said flexible joint and to be connected to the flexible riser.

13. A device as claimed in claim 10, further comprising spacers between said rigid pipe and said guide pipe.

14. A device as claimed in claim 10, wherein said guide pipe is divided and includes separate upper and lower guide sleeves, said upper guide sleeve to be mounted in a deck structure of the turret, and said lower guide sleeve to be mounted in a base structure of the turret.

15. A device as claimed in claim 14, wherein said guide sleeves have funnel-shaped ends.

16. A device as claimed in claim 14, further comprising spacers between said rigid pipe and said guide sleeves.

17. A device as claimed in claim 16, wherein said spacers are integral with said rigid pipe and abut said guide sleeves.

18. A device as claimed in claim 16, wherein said spacers have conical ends.

* * * * *